United States Patent [19]

Pfaffle

[11] 4,208,750

[45] Jun. 24, 1980

[54] METHOD AND CONSTRUCTION FOR BINDING CALENDARS AND THE LIKE

[75] Inventor: Ernst Pfaffle, Wuerttemberg, Fed. Rep. of Germany

[73] Assignee: Hans Sickinger Co., Pontiac, Mich.

[21] Appl. No.: 968,271

[22] Filed: Dec. 11, 1978

[51] Int. Cl.[2] ..... B42B 5/12

[52] U.S. Cl. ..... 11/1 A; 402/19

[58] Field of Search ..... 29/237.5; 402/19; 11/1 R, 1 A, 1 AC

[56] References Cited

U.S. PATENT DOCUMENTS

| | | | |
|---|---|---|---|
| 868,746 | 10/1907 | York | 281/28 |
| 2,273,824 | 2/1942 | Barrett | 11/1 A |
| 2,423,817 | 7/1947 | Rose | 281/25 |
| 2,435,561 | 2/1948 | Spinner | 264/160 |
| 3,038,181 | 6/1962 | Nadherny | 11/1 |
| 3,124,818 | 3/1964 | Byland | 11/1 |
| 3,555,587 | 1/1971 | Seaborn | 11/1 |
| 3,576,690 | 4/1971 | Staats et al. | 156/273 |
| 3,763,513 | 10/1973 | Cooley | 11/1 A |
| 3,839,759 | 10/1974 | Staats et al. | 11/1 A |

FOREIGN PATENT DOCUMENTS

| | | | |
|---|---|---|---|
| 11341 | 3/1934 | Australia . | |
| 1146582 | 11/1957 | France | 11/1 AC |

*Primary Examiner*—John McQuade

*Attorney, Agent, or Firm*—Harness, Dickey & Pierce

[57] ABSTRACT

A method and construction for binding wide groups of sheets such as calendars so that they may be opened without sheet offset and completely folded back. The method comprises the steps of forming a series of elongated openings along one edge of the sheet group, providing flat binding strips, and feeding the binder strips toward the apertures while simultaneously deforming the binding strips just before they enter the apertures so as to cause them to have a coiled shape, whereby the binding strips will be fed in curved fashion through the apertures and their ends will overlap to form individual circular coils. The construction of the invention comprises means for feeding a flat binder strip toward the aperture in the sheet group, means immediately adjacent the aperture in the path of the binding strip being fed and so positioned as to deflect the binding strip into the aperture and cause it to deflect so as to form a coil, and means for continuing to feed the binding strip in circular fashion so that its ends overlap to form an individual coil passing through the aperture and around the edge of the sheet group. If the binding strip is of plastic material, the invention further comprises heating means positioned in advance of the deflecting means to temporarily soften the plastic.

18 Claims, 4 Drawing Figures

METHOD AND CONSTRUCTION FOR BINDING CALENDARS AND THE LIKE

BACKGROUND OF THE INVENTION

1. Field of the Invention

The invention relates to the binding of sheet groups, and more particularly to the binding of perforated sheets by plastic or metal binding elements. The invention is particularly concerned with the binding of items such as calendars.

2. Description of the Prior Art

Present methods of binding sheet groups of this type include spiral and zig-zag wire binders as well as plastic combs which have curved projecting fingers and a spine. A drawback of spiral binders is that the sheets will be offset sideways when they are folded back, detracting from the appearance of some calendars. In addition, some persons object to the possibility of exposed wire ends which could scratch. Plastic combs are expensive since they must be preformed, and insertion of this type as well as zig-zag binders is relatively slow. Automatic insertion is sometimes unavailable for the comb type of binder, and the spine of the comb prevents complete flat foldback of the sheets, desirable in a calendar and similar sheet groups.

A search on the subject matter of this invention revealed the following United States patents:

Spinner U.S. Pat. No. 2,435,561 showing a group of binder rings performed by rolling a sheet around a mandrel after resting it on a heated table.

Rose U.S. Pat. No. 2,423,817 showing metal T-members which are inserted and then bent.

Nadherny U.S. Pat. No. 3,038,181 showing ribbons of ring-forming plastic which are passed vertically through a guide after which the stack is moved horizontally to force the strips into an anvil, with an electrode welding their overlapping edges.

Byland U.S. Pat. No. 3,124,818 using plastic ribbons which are sealed.

The following patents which show different methods of binding stacks:

York U.S. Pat. No. 868,746
Seaborn U.S. Pat. No. 3,555,587
Staats et al. U.S. Pat. No. 3,576,690
Cooley U.S. Pat. No. 3,763,513
Staats et al. U.S. Pat. No. 3,839,759
Douvry Australian Pat. No. 11,341/33

For reasons which will become apparent, none of these patents are believed to anticipate or teach the present invention.

BRIEF SUMMARY OF THE INVENTION

It is an object of the invention to provide a novel and improved method and construction for binding sheet groups such as calendars, which avoids some of the disadvantages of previously known methods as discussed above, and permits the sheets to be bent back completely without any lateral offset.

It is another object to provide an improved method and construction of this nature which is adaptable to high speed continuous production and is economical and reliable in use.

It is also a object to provide a method and construction of this nature which permits the use of existing perforating tooling for the sheet group edges.

It is another object to provide a binding method and construction having these characteristics, which results in an attractive as well as serviceable binding for the sheet groups.

Briefly, the method of the invention comprises the steps of forming a series of elongated apertures along one edge of the sheet group, providing flat binding strips, and feeding the binding strips toward the apertures while simultaneously deforming the binding strips just before they enter the apertures so as to cause them to have a coiled shape, whereby the binding strips will be fed in curved fashion through the apertures and their ends will overlap to form individual circular coils.

The construction of this invention comprises means for feeding a flat binder strip toward the aperture in the sheet group, means immediately adjacent the aperture in the path of the binding strip being fed and so positioned as to deflect the binding strip into the aperture and cause it to deflect so as to form a coil, and means for continuing to feed the binding strip in circular fashion so that its ends overlap to form an individual coil passing through the aperture and around the edge of the sheet group.

DESCRIPTION OF THE PREFERRED EMBODIMENT

Figures 1, 2:
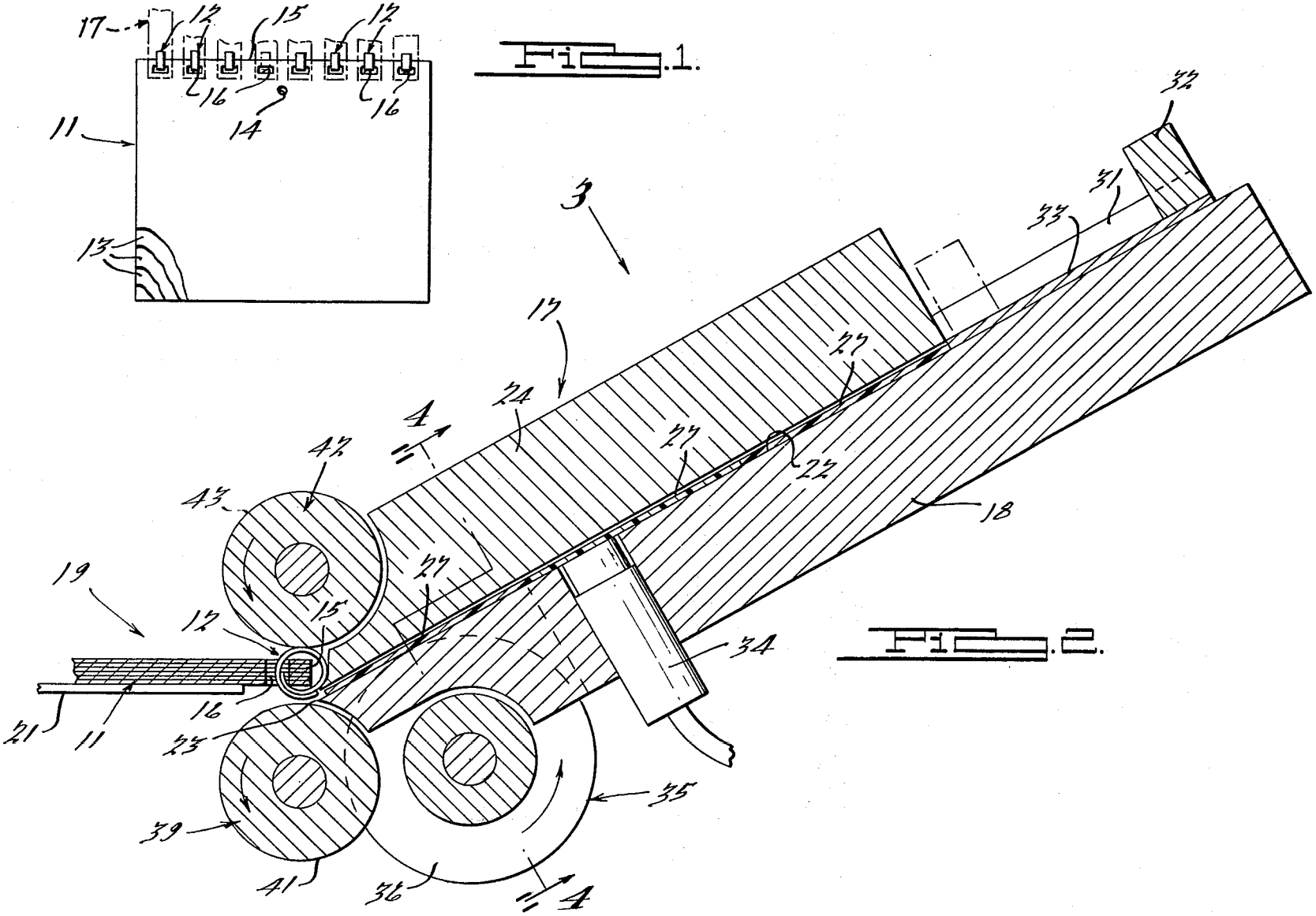
FIG. 1 is an elevational view of the sheet group such as a calendar bound in accordance with the principles of this invention.
FIG. 2 is a cross-sectional view in elevation showing the application of the invention to plastic binding.

FIG. 1 shows a group of sheets generally indicated at 11 which may be a calendar or the like and which is held together by binders generally indicated at 12 and made according to the present invention. The calendar is shown as having a plurality of sheets 13 with a central aperture 14 adjacent the upper edge of the sheet group, for the purpose of hanging the calendar on a wall. For this purpose it is necessary to fold back completely each sheet at the end of the month, and it is an object of the invention to permit such complete fold-back without lateral shifting of the sheets which could detract from the appearance of the calendar.

Upper edge 15 of the calendar is provided with a series of rectangular apertured portions 16. These are similar to those used with a conventional plastic comb type of fastener, and the same perforating equipment could thus be used to carry out the present invention. The size and number of binders 12 will depend upon the length of edge 15, the thickness of the sheets and sheet group, and similar factors.

Each binder 12, as seen in FIG. 2, comprises a ring of material the ends of which overlap but are not fastened together. The degree of overlap could vary, the total ring size being preferably between $1\frac{1}{4}$ and 2 complete turns. The material of which each binder 12 is made could be metal or plastic having the desired qualities of deformability and resiliency which are brought forth in more detail below.

Figure 3:
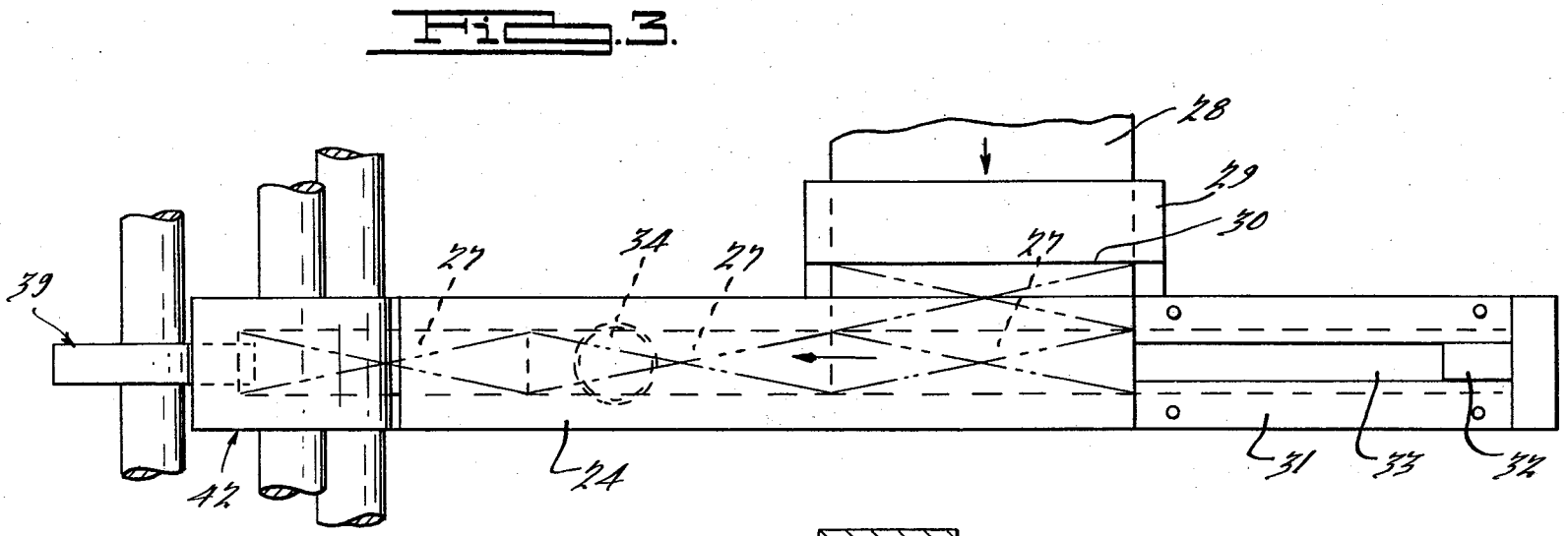
FIG. 3 is a top plan view of the construction of FIG. 2 in the direction of the arrow 3 thereof.
Figure 4:
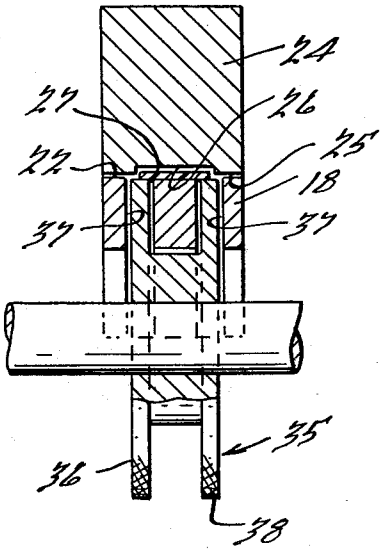
FIG. 4 is a cross-sectional view in elevation taken along the line 4—4 of FIG. 2.

FIGS. 2, 3 and 4 show a suitable mechanism for carrying out the method of this invention with respect to plastic binders 12. Although only one mechanism is illustrated, generally indicated at 17 in FIG. 2, it will be understood that, for quantity production, a similar mechanism will be located in alignment with each aperture 16 of sheet group 11, so that binders 12 may be simultaneously applied through all the apertures.

Mechanism 17 comprises an inclined strip support 18 adjacent a station generally indicated at 19 at which apertured sheet group 11 is held in a horizontal position by a suitable support indicated partially and schematically at 21. Strip support 18 has a flat upper surface 22 which is inclined downwardly, the lower end 23 of this surface being immediately below and behind edge 15 of the sheet group. A retaining member 24 is mounted above support 18, this retaining member (FIG. 4) having a lower surface 25 closely adjacent surface 22. A groove 26 is formed in surface 25 for the guidance of strips 27 which are to form binders 12. These strips are indicated by X's in FIG. 3.

The strips are formed from binding material 28 shown in FIG. 3 which is fed laterally through a guide 29 to the space between members 18 and 24. Cutting means indicated schematically at 30 may be provided for cutting the binding material into strips of the proper width. These strips are then fed into groove 26 where they rest on support surface 22.

Guides 31 are provided for a reciprocating feed mechanism 32 mounted at the rearward end of support 18 and having a flat pusher 33 for feeding the strips toward the booklet. Feed member 32 is reciprocable between its solid line and dot-dash line positions in FIG. 2, the travel distance being equal to the length of the strip. As shown, three strips in tandem are held by groove 26 with the lowermost strip 27 having its forward end adjacent the lower end 23 of support 18.

A heater 34 is mounted in support 18 in such a position that it will heat and soften each plastic strip 27 as it approaches the exit end of the support. The material and heating means are so chosen that the plastic will be deformable as it leaves exit end 23 of support 18 and will hold its deformed shape after cooling. An example of a suitable plastic material is polyvinyl chloride.

A drive wheel generally indicated at 35 is mounted at the lower end of support 18, for the purpose of feeding each softened strip 27 into its aperture 16. Drive wheel 35 has a pair of flanges 36 disposed within grooves 37 formed in the lower end of support 18. These flanges are knurled as shown at 38 in FIG. 4 and are so positioned as to engage the outer edges of the underside of each softened strip 27. Rotation of drive wheel 35 in the direction of the arrow in FIG. 2 will thus advance the softened strip 27 toward aperture 16.

A deflecting wheel generally indicated at 39 is rotatably mounted immediately forwardly of drive wheel 35 and closely adjacent end 23 of support 18. Outer surface 41 of deflecting wheel 39 is positioned above the plane containing surface 22 and closely adjacent aperture 16. A second deflecting wheel generally indicated at 42 is disposed immediately above aperture 16, and its surface 43 is also closely adjacent the aperture so as to further deflect the strip 27. The two wheels are driven in the directions of the arrows shown in FIG. 2 so that the softened strip 27 will be deformed into a circular path and caused to pass through its aperture 16 so as to form a ring.

In carrying out the method of this invention with the mechanism 17, booklet 11 will be positioned at station 19 so that its apertures 16 are aligned with a series of mechanisms 17. Feed members 32 of these mechanisms will be moved downwardly and to the left in FIG. 2, while drive wheels 35 and deflecting wheels 39 and 43 rotate. The softened plastic strips 27 will be fed through apertures 16, being deflected to form ring-like binders 12. The strips will cool after being formed so that the binders will retain their shape. Each feed member 32 may then be retracted so as to receive the next strip 27 from binder material 28, while bound booklet 11 is replaced with another booklet.

The mechanism for carrying out the invention with respect to metal binders will be similar to that shown in FIGS. 2 to 4 except that the heating means will be unnecessary. That is to say, feeding means for the strips of metal as well as deflecting means for causing the deformable metal to assume a ring-like shape as shown in FIG. 2 will be provided. Each time a strip is fed toward an aperture 16 it will be deformed so as to assume a ring-like configuration as it is fed into the aperture, and this formation will be retained so as to create a binder.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

I claim:

1. A method for binding wide groups of sheets as calendars, comprising the steps of forming a series of elongated apertures along one edge of the sheet group, placing said edge at a binding station, providing unconnected flat binding strips adjacent said apertures, providing stationary binding strip deforming means between each binding strip and its aperture which is clear of the aperture, and feeding the binding strips toward the apertures while simultaneously deforming the binding strips with said stationary means just before they enter the apertures so as to cause them to have a coiled shape, whereby the binding strips will be fed in curved fashion through the apertures, their ends will overlap to form individual circular coils, and the bound sheet group may be removed without disturbing said stationary binding strip deforming means.

2. The method according to claim 1, including the steps of providing plastic material for said strips which is deformable when heated and retains its deformed shape when cooled, and heating each of said strips immediately before it is deflected into its coiled shape.

3. A method according to claim 1, further including the steps of supporting a sheet group at a binding station and feeding and deforming strips into all of said apertures simultaneously.

4. A method of binding wide groups of sheets such as calendars comprising the steps of forming a series of elongated apertures along one edge of the sheet group, providing a series of flat binding strips in tandem for each aperture, urging the rearward end of each series toward its aperture while simultaneously deforming the binding strips just before they enter the apertures so as to cause them to have coiled shapes, each series being guided whereby the forwardmost strip in the series is deflected into its aperture, whereby the binding strips will be fed in curved fashion through the apertures and their ends will overlap to form individual circular coils.

5. In a structure for binding, a sheet group having an apertured edge, a binding station having means adapted to support said sheet group with the apertures exposed, a support having a surface extending toward said binding station with the exit end of said surface closely adjacent said edge, an elongated flat binding strip supported by said surface, said binding strip being fabricated of a material which is capable of being deformed and retaining its deformed shape, means for advancing said strip toward said exit end of the support, and stationary deflecting means between said exit end and said aperture in the path of said advancing strip but clear of said aperture and so shaped as to cause the advancing strip to enter said aperture and at the same time be deformed into a ring-like shape, said stationary deflecting means being in non-interfering relation with the placement and removal of said sheet group at said binding station, the length of said strip being sufficient to cause the ends thereof to overlap as it is being advanced and deformed.

6. The combination according to claim 5, said advancing means comprising a drive wheel engageable with a portion of said strip while resting on said support surface.

7. The combination according to claim 6, said drive wheel having a pair of flanges engageable with opposite side edges of said strip.

8. In a structure for binding, a sheet group having an apertured edge, a binding station having means adapted to support said sheet group with the apertures exposed, a support having a surface extending toward said binding station with the exit end of said surface closely adjacent said edge, an elongated flat binding strip supported by said surface, said binding strip being fabricated of a material which is capable of being deformed and retaining its deformed shape, means for advancing said strip toward said exit end of the support, and deflecting means between said exit end and said aperture in the path of said advancing strip and so shaped as to cause the advancing strip to enter said aperture and at the same time be deformed into a ring-like shape, the length of said strip being sufficient to cause the ends thereof to overlap as it is being advanced and deformed, said deflecting means comprising a deflecting wheel adjacent said exit end of the support surface, said deflecting wheel having an outer surface projecting above the plane of said support surface.

9. The combination according to claim 8, said deflecting means further comprising a second deflecting wheel on the opposite side of said apertured edge from said first deflecting wheel.

10. The combination according to claim 9, further provided with means driving said deflecting wheels.

11. The combination according to any of claims 5 through 7, further provided with a reciprocable feed member on said support for urging said strip toward the exit end thereof.

12. The combination according to any of claims 5 through 7, said strip being fabricated of a plastic material, and heating means on said support for warming and softening said plastic material as it passes over the heating means.

13. The combination according to any of claims 6 through 9, further provided with means for feeding binding material laterally toward said support and cutting said binding material into strips to be placed on the support.

14. The combination according to claim 13, further provided with a retaining member above said support, and a groove on the underside of said retaining member closely adjacent the support surface for retaining said strip.

15. The combination according to claim 5, further provided with a series of said supports, and advancing means and deflecting means adjacent said binding station and aligned with the apertures of said sheet group, whereby a plurality of binding strips may be simultaneously fed into all the apertures of a sheet group.

16. The combination according to claims 8 or 9, further provided with a reciprocable feed member on said support for urging said strip toward the exit end thereof.

17. The combination according to claims 8 or 9, said strip being fabricated of the plastic material, and heating means on said support for warming and softening said plastic material as it passes over the heating means.

18. In a structure for binding, a sheet group having an apertured edge, a binding station having means adapted to support said sheet group with the apertures exposed, a support having a surface extending toward said binding station with the exit end of said surface closely adjacent said edge, an elongated flat binding strip supported by said surface, said binding strip being fabricated of a material which is capable of being deformed and retaining its deformed shape, means for feeding binding material laterally toward said support and cutting said binding material into strips to be placed on the support, and deflecting means between said exit end and the aperture in the path of said advancing strip and so shaped so as to cause the advancing strip to enter said aperture and at the same time be deformed into a ring-like shape, the length of said strip being sufficient to cause the end thereof to overlap as it is being advanced and deformed.

* * * * *